United States Patent [19]

Schleimann-Jensen

[11] 4,383,723

[45] May 17, 1983

[54] PROCEDURE FOR MANUFACTURING GAS-FILLED DISCHARGE DEVICES

[75] Inventor: C. Arne Schleimann-Jensen, Stockholm, Sweden

[73] Assignee: TII Industries, Copiague, N.Y.

[21] Appl. No.: 213,909

[22] Filed: Dec. 8, 1980

[51] Int. Cl.[3] ..... H01T 21/00

[52] U.S. Cl. ..... 445/54; 445/73

[58] Field of Search ..... 316/24, 30; 228/219, 228/220

[56] References Cited

U.S. PATENT DOCUMENTS

| | | | |
|---|---|---|---|
| 3,701,578 | 10/1978 | Krey | 316/24 |
| 3,882,596 | 5/1975 | Kendziora et al. | 228/219 X |
| 4,082,392 | 4/1978 | Golin | 316/24 X |
| 4,294,395 | 10/1981 | Nayar | 228/220 |

FOREIGN PATENT DOCUMENTS

| | | | |
|---|---|---|---|
| 54-56275 | 5/1979 | Japan | 316/20 |
| 55-96537 | 7/1980 | Japan | 316/24 |
| 375201 | 4/1975 | Sweden . | |

*Primary Examiner*—Kenneth J. Ramsey
*Assistant Examiner*—M. Jordan
*Attorney, Agent, or Firm*—Leonard W. Suroff

[57] ABSTRACT

Gas-filled discharge tube for use as transient protection, with at least two electrodes separated by a discharge gap and an insulating body which is joined to the electrodes and, jointly with them, forms a discharge chamber. The sealing of the tube occurs at atmospheric pressure and a suitable temperature, in a mixture of a light and a heavy gas suitable for the purpose, after which the tube is enveloped in a suitable heavy gas at atmospheric pressure, while the temperature is adjusted in such a manner that the light gas enclosed in the tube, through diffusion and a partial pressure difference, exits through the insulating body, whereas the heavy gases can only to an insignificant degree diffuse through the insulating body. The gas diffusion brings about a reduction in the total gas pressure inside the tube and the process is interrupted when the desired pressure drop is obtained.

10 Claims, 3 Drawing Figures

PROCEDURE FOR MANUFACTURING GAS-FILLED DISCHARGE DEVICES

BACKGROUND OF THE INVENTION

Gas-filled discharge tubes are extensively used as protection against transient voltages in electronic equipment of various kinds, e.g. telephone equipment, computers, and safety systems. Discharge tubes for this special purpose consist, as a rule, of at least two electrodes which, with a suitable distance between them, are joined to an insulating body, so as to form at least one discharge gap in a discharge chamber that is vacuum-tight at normal temperatures and which encloses a gas of a suitable kind at a suitable pressure. The insulating body is, as a rule, made of ceramics. Two electrode tubes are used most often. The tube can be connected between conducting points which can be exposed to transient voltages, or between such a point and the ground. Three-electrode tubes are also being used. A central electrode, as a rule, is connected to the ground, whereas the outer electrodes are connected to the points to be protected.

The electrode material of the tube, the size of the electrode gap and the type and pressure of the gas will determine the firing or striking voltage of the tube. The latter must be adjusted in such a way that the tube will not ignite at the normally applied voltages. However, if voltages originate which could harm the equipment, the tube will ignite and cause the voltage to drop in the tube and thus in the protected equipment, thereby preventing the occurrence of damage.

Since the discharges occuring between the electrodes generate a displacement of materials between same, there is a certain risk of disturbances in the form e.g. of short circuits in the electrode gap. For that reason, gaps between the electrodes are rarely very small. The gaps mostly used are of the order of magnitude of 0.4–0.5 mm. As filler gaps, argon is frequently used, possibly with an addition of about 11% of hydrogen. Sometimes krypton and xenon are used instead of argon. In connection with copper electrodes and an electrode gap of about 0.5 mm, a gas pressure is frequently selected which measures about 10 kPa at normal room temperature. This will ensure a frequently desirable starting voltage of about 350 V. If, for any reason, it is desired to manufacture a tube for higher gas pressures, the electrode gap should be reduced accordingly, since the product of gap and pressure must not change if the firing voltage is to remain unchanged as well. As already stated above, gap disturbances can be a problem.

As mentioned before, an insulating body of ceramics, designed as a hollow cylinder, is used most frequently. The tube is usually manufactured in such a way that the end surfaces of the ceramic unit are metalized, often by means of a coat of molybdenum-manganese and an overcoat of nickel. The electrodes can then be soldered to this metalized layer. If the electrodes are of copper, e.g. a silver-copper eutectic can be used as suitable soldering material at about 800° C. Other electrode material may require a different kind of soldering metals. As a rule, the soldering, together with the rest of the process, follows either one of the two methods described below.

In one case a ring of soldering material is positioned on the portion of the electrode surface to be soldered to one metalized end surface of the ceramic tube. The ceramic tube is placed on the solder ring, while a new solder ring is positioned on the other metalized end surface of the ceramic tube, and the second electrode is placed on that other end. This electrode has been outfitted with a passage-providing narrow copper tube, to form an open channel for the internal volume of the tube. The soldering is done most often in a belt furnace with reducing gas, usually hydrogen or a mixture of hydrogen and nitrogen. The temperature depends on the soldering material, with the silver-copper eutectic, this is, as mentioned, about 800° C. The soldering is followed by vacuum pumping at about 400° C., and by a refilling or replenishing with the desired gas up to the desired pressure. Pumping and refilling or replenishing are frequently performed manually in so-called pump boxes. However, semi-automatic devices are occasionally also used. Vacuum pumping and refilling or replenishing occur through the tube, the so-called exhaust tube, which one of the electrodes has been provided with. At times, a small portion of the refilling or replenishing gas is replaced by tritium, a radio-active isotope of hydrogen, which has a certain stabilizing effect on the firing voltage of the tube. After vacuum pumping and gas refilling or replenishing have been completed, the copper tube is nipped off near the electrode. This nipping off, as a result of cold diffusion, will cause a vacuum-tight joint. The manufacturing process concludes with an electrical stabilizing treatment prior to the final test.

The second method calls for stacking of the tube parts in the same manner as above. However, in this case no exhaust tube is used. The stacked tube parts are placed in suitable numbers on a plate of suitable material, and a number of these plates are placed, jointly, into a furnace. The furnace is pumped down to a vacuum of about 0.01 Pa at a temperature slightly below the melting point of the soldering material. Since the tube parts are stacked loosely, there will also be a vacuum in the internal volume of the stacks. Subsequently, at the same temperature, replenishing gas is fed into the furnace and thus also into the stacked tubes. The temperature is then raised, and thus, the tubes are soldered together within the gaseous atmosphere. As in the previous case, after cooling, an electrical stabilizing treatment is applied prior to the final test.

Also in the case of tubes manufactured according to the second method, it is sometimes desired to mix a small amount of tritium with the filler gas. However, since the gas in the furnace is, after cooling, ventilated after each pumping turn or cycle, it is inconceivable to mix tritium with the filler gas. Instead, a diffusion process, cf. e.g. Swedish Pat. No. 375,201 is frequently used after the completed pumping process.

Variants of these two manufacturing methods are sometimes used, but the feature that all of them have in common is that they are very cumbersome, require a lot of energy and manufacturing equipment, and are not suited for automatic in-line production.

SUMMARY OF THE INVENTION

With the manufacturing process according to the invention, excellent possibilities for automatic in-line production are obtained. In addition, the method makes it possible to reduce the total consumption of raw materials, energy, and labor, and to use less complicated and sturdier manufacturing equipment than the one required in the above-described, well known manufacturing methods.

This invention is based, in part, on the property of the gases to equalize, through diffusion, any partial pressure differences within the limits of volume, and, in part, on the varying capacity of the gases to penetrate, e.g. glass and ceramics, through diffusion. In the first case, the diffusion velocity is inversely proportional to the square root of the gas density. This means that, e.g. hydrogen, diffuses about 4.6 times faster than argon, under identical conditions.

In the second case, the temperature and the diameter of the gas molecule play an essential part. The penetration through, e.g., ceramics, brought about by the diffusion, varies substantially more in this case than in the first one. The difference may be as high as several times the 10th power between a gas with a small molecule diameter and low density, e.g., hydrogen and helium, and a gas with a large molecule diameter and high density, e.g., argon, krypton, and xenon. In the following, gas with a small molecule diameter and low density shall be designated as a light gas, whereas gas with a large molecule diameter and high density shall be called a heavy gas.

The above-described diffusion conditions, according to the invention, are used for the manufacturing of discharge tubes for transient protection purposes. The characteristics of the manufacturing method according to the invention can be seen from the attached claims.

BRIEF DESCRIPTION OF THE DRAWINGS

The invention will be explained in greater detail in relation to FIGS. 1–3, in which.

DETAILED DESCRIPTION OF THE DRAWINGS

Figure 1:
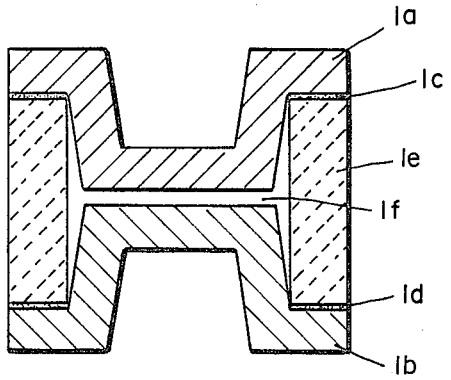
FIG. 1 shows a conventional embodiment of a two-electrode tube for transient protection, FIG. 2 gives a basic example of a furnace design for the manufacturing according to the invention.

FIG. 1 shows how the electrodes 1*a* and 1*b*, the solder rings 1*c* and 1*d*, and the ceramic tube 1*e* are stacked. The dimensions are selected in such a way that a gap 1*f* is formed between the electrodes. The solder rings 1*c* and 1*d* can be designed in such a way that, prior to the melting of the solder, they have not too tight a fit to the ceramic 1*e* and the electrodes 1*a* and 1*b*. This has a certain importance in that the tube, after stacking, is approximately at atmospheric pressure in a mixture of a suitable light and heavy gas, such as hydrogen and argon, which will partly envelop the tube and partly enter it, and replace the air present therein. This occurs suitably by heating to a temperature slightly below the melting temperature of the soldering material. The soldering of the tube parts, and thus the sealing of the tube, is then brought about by raising the temperature until the solder melts. When the soldering material consists of a silver-copper eutectic, a soldering temperature of about 800° is customary. The temperature is subsequently lowered to a value slightly below the setting temperature of the solder and which for the silver-copper eutectic is the same as the melting temperature.

After sealing, the gas mixture enveloping the tube is replaced by argon at substantially the same pressure as that of the gas mixture, i.e. substantially at atmospheric pressure, and at a temperature slightly below the sealing temperature. The gas pressure inside and outside the tube remains about the same, but the partial pressure of hydrogen and argon inside the tube will have changed in relation to the outside gas. The partial pressure of the hydrogen is higher inside the tube than outside, whereas the reverse condition applies to the argon. This phenomenon, at the prevailing temperature, brings about a diffusion-based exit of hydrogen through the ceramics, while leaving the argon content in the tube practically unchanged, notwithstanding the fact that the partial pressure of the argon is higher outside the tube than inside. The result is that the gas pressure inside the tube starts dropping to a value which depends on the original composition of hydrogen and argon in the enclosed gas mixture, as well as on the kind, thickness, and area of the ceramics, and the temperature and time.

It has been stated above that, when using argon with 10%–15% hydrogen, a total gas pressure is often desired which, at room temperature, would be of the order of magnitude of 10–12 kPa. This means that the partial pressure of argon in a finished tube must be about 10 kPa. Since the amount of argon in the tube changes only insignificantly during the diffusion phase, the corresponding partial pressure at a sealing temperature of 800° C. will, according to the gas laws, be 36 kPa. Within an unchanged volume, the gas pressure is changed by a factor equal to the ratio between the Kelvin value of the temperature, in this case 1073° K. respectively 298° K., or a ratio of 3.6. The sealing is assumed to occur substantially at atmospheric pressure, i.e. at about 100 kPa. Consequently, hydrogen is added until the argon-hydrogen mixture reaches a total pressure of about 100 kPa.

With the subsequent diffusion, the hydrogen, as described above, exits through the walls of the sealed tube. This process is interrupted when the gas mixture in the tube has reached the correct mixture ratio and pressure. Any desired tritiating, or treatment with tritium, can now be done in the same manner as mentioned previously, namely through diffusion according to the Swedish Pat. No. 375,201.

Figure 2:
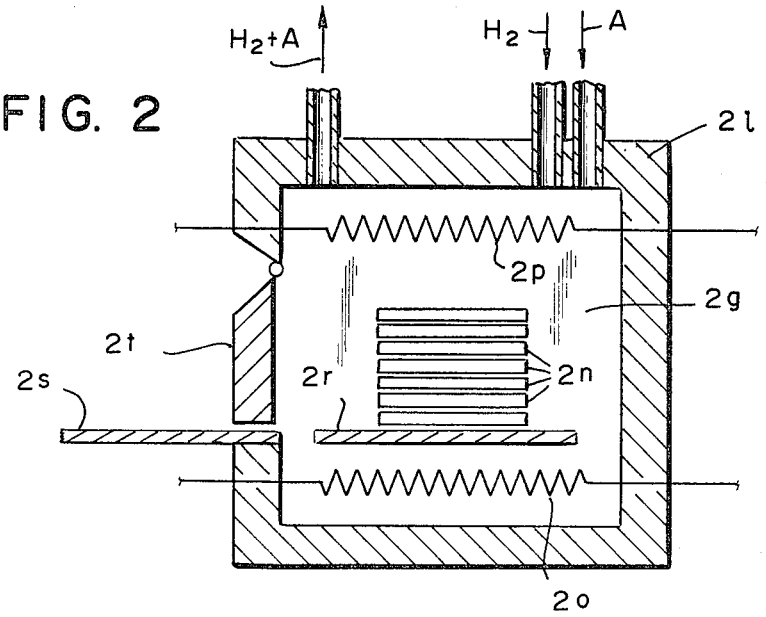

FIG. 2 gives an example how equipment for the above-explained manufacturing can basically be designed. In the furnace chamber 2*g*, a number of plates 2*n* with stacked tube parts can be placed on the support 2*r*, after having been moved from the outer support 2*s* into the furnace chamber through the opening 2*t*. Suitable gases, such as hydrogen ($H_2$) and argon (A), in quantities suited to the manufacturing phases, can flow through the furnace chamber substantially at atmospheric pressure. In addition, with the aid of the electric resistance elements 2*o* and 2*p*, the furnace chamber can be heated to a temperature suited to each phase. The process finishes by cooling brought about, as the case may be, by forcing an increased stream of water through the cooling jacket 2*l* or by increasing the flow in the furnace chamber of the argon used at the conclusion of the diffusion phase of the process. Instead of argon, one can use, e.g., also nitrogen, for cooling. After cooling to about 60° C., the tubes are removed from the furnace and a new processing cycle is started.

The manufacturing according to the invention is well suited for in-line production. Thus, in FIG. 3, a furnace is shown, consisting of a sealing section 3*g*, a diffusion section 3*h* and a cooling section 3*i*. The sections are separated by the walls 3*j* and 3*k* which are provided with openings through which the plates with the stacked tube parts 3*n* and the conveyor belt 3*m* can pass. The openings also allow the gases, such as argon (A) and hydrogen ($H_2$), to flow in the desired manner, e.g., as indicated by the arrows. Heating of the furnace occurs by means of the resistance elements 3*o* and 3*p*, in such a way that the temperature in the sealing section 3*g* is gradually raised in the direction of motion of the conveyer belt, and reaches the soldering temperature before passing through the partition 3*j* into the diffusion section 3*h*. In the diffusion section, the temperature is slightly lower than the temperature in the sealing section 3*g*. In the cooling section 3*i*, which is provided with a water cooling jacket 3*l* the tube is cooled to a temperature which can suitably be 60° C. or lower.

Instead of letting the plates with stacked parts and, subsequently, the soldered tube parts, pass through the furnace, the stacked tube parts can be placed directly in a row on the conveyor belt 3*q*, immediately in front of the furnace. In this case it will be natural to switch to fully automatic stacking of the parts. Under these conditions, it is advantageous to fix, first, the solder rings mechanically on the electrodes or on the metalized part of the ceramics. As an alternate, the electrodes or ceramics can be plated with soldering material. In a two-electrode device, there will then remain only three parts to be stacked. First one electrode, then the ceramics, and, finally, the second electrode, see FIG. 1.

Instead of placing only one row of tubes on the conveyer belt, automatic stacking can of course be arranged in such a manner that several rows are placed side by side on the belt.

Figure 3:
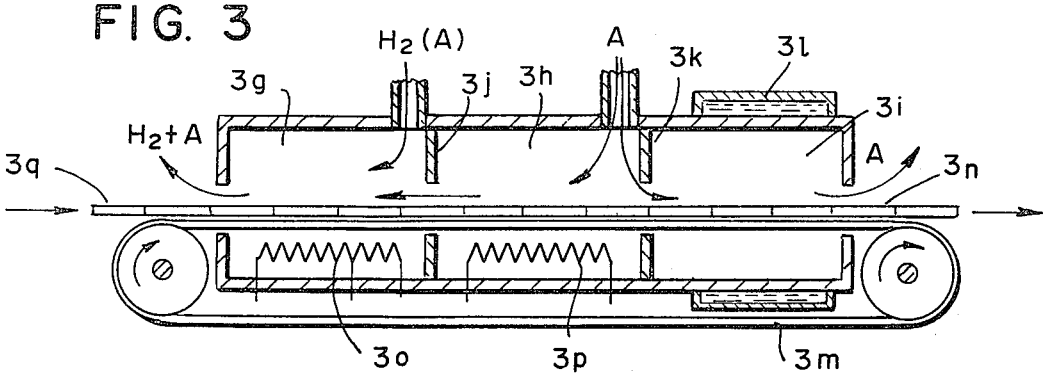
FIG. 3 shows an example of belt-fed furnace equipment for the manufacturing according to the invention.
Figure 5:
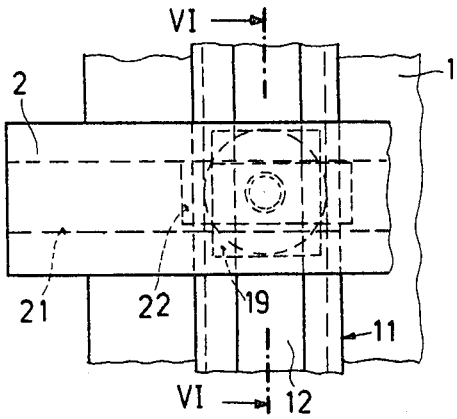
Figure 6:
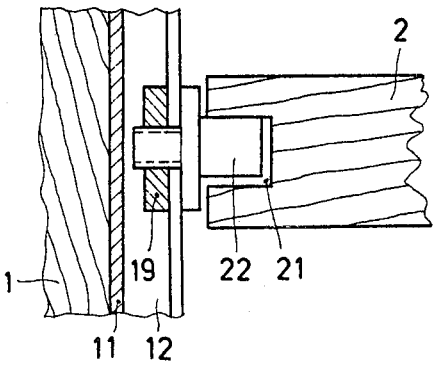
Figure 7:
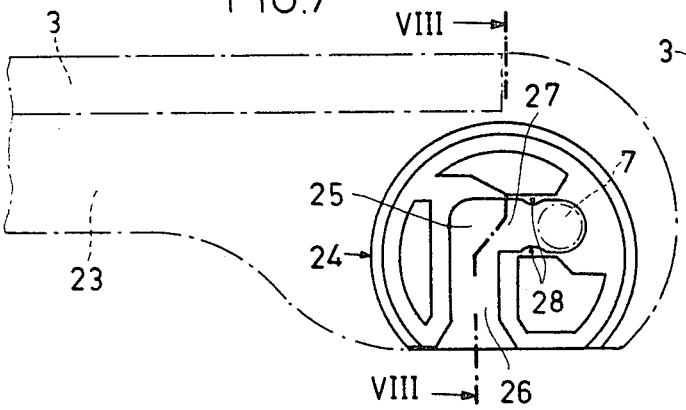
Figure 8:
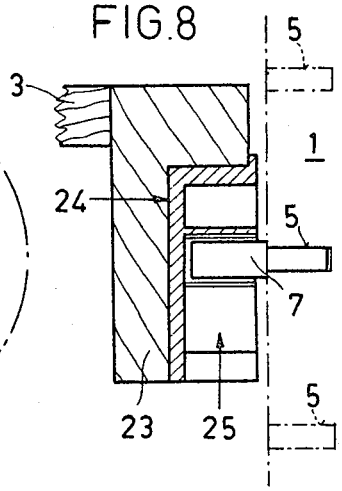
Figure 9:
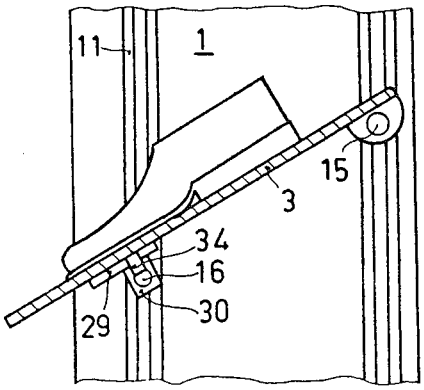
Figure 10:
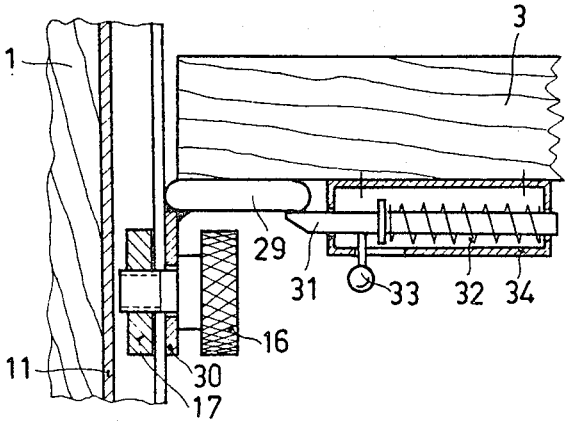
Figure 11:
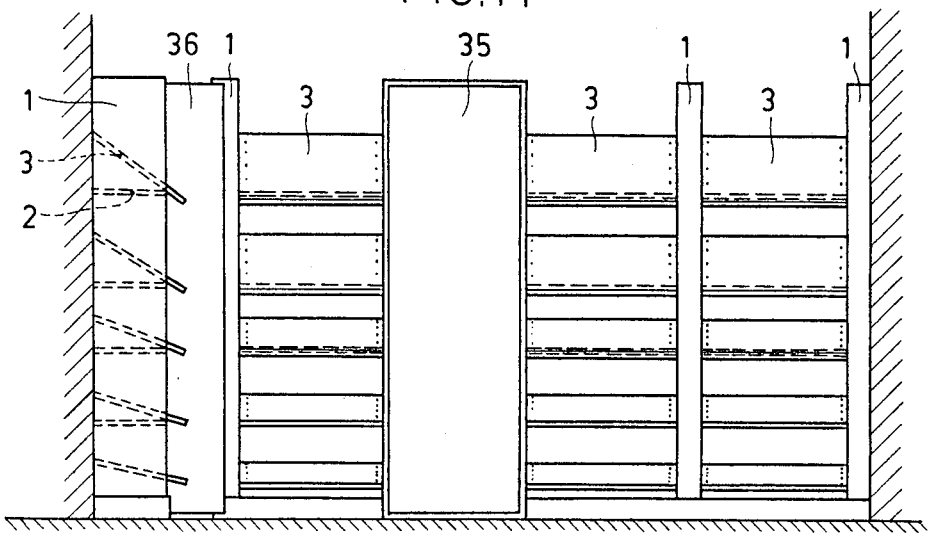
Figure 12:
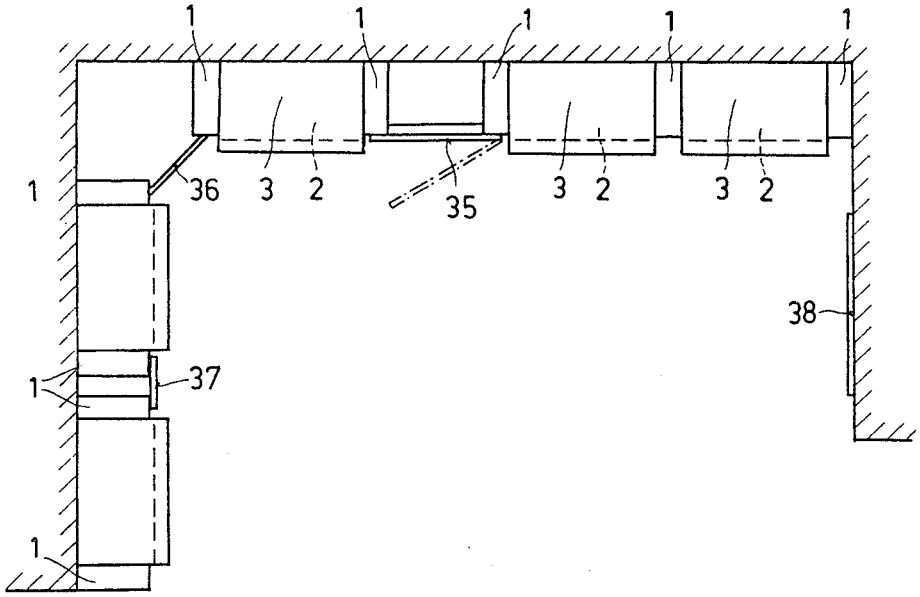
Figure 13:
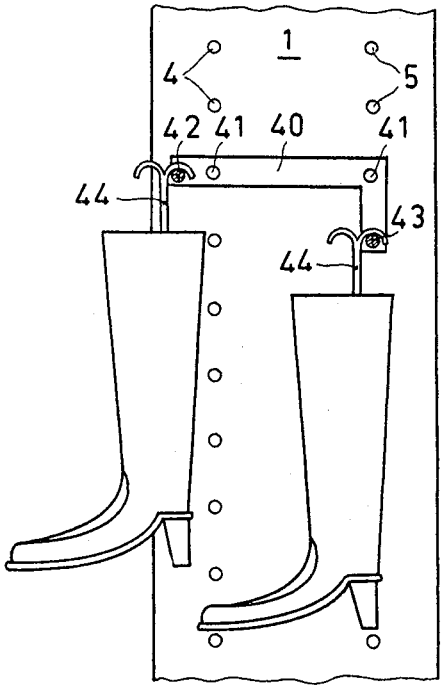
Figure 14:
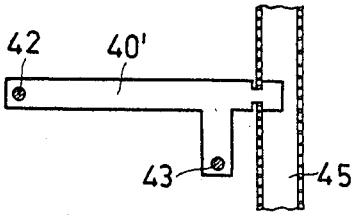

It is possible to connect, without further ado, equipment for sintering and subsequent metalizing of pressed ceramic bodies upstream of the manufacturing equipment shown in FIG. 3. Pressing and surface treatment of electrodes can also be connected. Furthermore, it is also possible to connect automatic equipment for the electric treatment and testing of the tubes downstream of the equipment shown in FIG. 3.

Accordingly, the method for manufacturing a gas-filled discharge tube, designed, e.g., as transient protection, is disclosed. The tube contains at least two electrodes and an insulating body holding the electrodes joined vacuum-tight, with the electrodes and the insulating body dimensioned and arranged in such a way that at least one discharge gap is present in the tube, characterized in that the tube components, e.g. through sealing, as by soldering or brazing, at a suitable temperature, are joined and sealed substantially at atmospheric pressure in a light gas mixed with another gas which is heavier than the first mentioned gas, and which, according to the function of the finished tube, is desirable. Thereafter the tube with its enclosed gas mixture is processed by exposing it in a gas, substantially at atmospheric pressure, which has about the same density as the heavy portion of the enclosed gas mixture. The temperature is adjusted so as to be lower than the sealing temperature, and the heavy gases can only to an insignificant degree penetrate the tube walls through diffusion, whereas, on the other hand, the enclosed light gas can diffuse through the walls so that, as a result of the partial pressure difference, the light gas will exit through the walls of the tube, thus causing a reduction in the total gas pressure inside the tube.

The light gas may be hydrogen or helium or a mixture thereof, whereas the heavy gas is generally argon, krypton, or xenon or a mixture thereof. Furthermore, the process is characterized in that the heavy gas entering the utilized gas mixture at the joining and sealing of the tube components forms such a large portion thereof that its partial pressure at the sealing corresponds, according to the gas laws, to the desired partial pressure at room temperature for this gas. Whereas the light gas is added in such an amount that the total pressure of the gas mixture at the sealing temperature is approximately equal to atmospheric pressure.

The manufacturing process can be performed in a one-chamber furnace with arrangements, in part, for placing a number of plates with stacked tube components, in part, for heating to the desired temperature, and, in part, for allowing the flow through the furnace, substantially at atmospheric pressure, a mixture of a light gas and a heavy gas, intended for the joining and sealing of the tube, followed by the flowing through, substantially at atmospheric pressure, of a heavy gas to bring about the diffusion and exit of the desired amount of light gas enclosed in the tube, and, finally, the flowing through of a gas that is suitable in the cooling phase, and which can be the same gas as that used in the diffusion stage.

The manufacturing process can also occur in a belt furnace with a conveyer belt passing through three sections, substantially at atmospheric pressure, of which the first section is being traversed by a light gas mixed with a heavy gas at a temperature adjusted for joining and sealing of the tube, the second section is being traversed by a heavy gas at a suitable temperature for the diffusion and exit of the desired amount of light gas enclosed in the tube, and finally, the third section is being traversed by a gas that is suitable in the cooling phase, and which can be the same gas as that used in the diffusion section.

The furnace is divided into at least three sections through which the conveyer belt moves continuously and gradually, and where arrangements exist to bring about a suitable temperature and the passing through, mainly at atmospheric pressure, of suitable gases for the joining and sealing of tubes in the first section, the diffusion and exit of gas through the tube walls in the second section, and the cooling in the third section, besides which the inlet of the heavy gas for the diffusion stage is placed in such a manner that, in the largest part of the diffusion section, the gas has a direction of motion opposite that of the belt.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A method for manufacturing a gas-filled discharge tube, designed, e.g., as transient protection, containing tube components comprised of at least two electrodes and an insulating body holding the electrodes joined vacuum-tight, with the electrodes and the insulating body dimensioned and arranged in such a way that at least one discharge gap is present in the tube, comprising the steps of:

A. sealing at a suitable temperature the components of the tube in a gas-flow substantially at atmospheric pressure and consisting of a light gas mixed with another gas which, in view of the function of the finished tube, is desirable and heavier than the first-mentioned gas, B. exposing the tube with its enclosed gas mixture in a gas-flow, substantially at atmospheric pressure, which has about the same density as the heavy portion of the enclosed gas mixture, and C. adjusting the temperature so as to be lower than the sealing temperature, whereby the heavy gases can only to an insignificant degree penetrate the tube walls through diffusion, and the enclosed light gas can diffuse through the walls so that, as a result of the partial pressure difference, it will exit through the walls of the tube, thus causing a reduction in the total gas pressure inside the tube.

2. A method according to claim 1, wherein the light gas is hydrogen or helium or a mixture thereof, whereas the heavy gas is argon, krypton, or xenon or a mixture thereof.

3. A method according to claim 1, wherein the heavy gas entering the utilized gas mixture at the joining and sealing of the tube components forms such a large portion thereof that its partial pressure at the sealing corresponds, according to the gas laws, to the desired partial pressure at room temperature for this gas, whereas the light gas is added in such an amount that the total pressure of the gas mixture at the sealing temperature is approximately equal to atmospheric pressure.

4. A method according to claim 1, wherein the components of the tube are placed in a process chamber in which it successively is influenced by suitable temperatures and corresponding suitable gas-flow substantially at atmospheric pressure for the accomplishment of sealing, diffusion, and cooling.

5. A method according to claim 1, including the step of moving the components of the tube through a process chamber having sections, each section having a suitable temperature and corresponding suitable gas-flow substantially at atmospheric pressure for the accomplishment of sealing, diffusion, and cooling, respectively.

6. A method according to claim 5, wherein the gas-flow direction in the process chamber sections for sealing and for diffusion is opposite to the tube movement direction through these sections.

7. A furnace for the manufacturing of gas-filled discharge tubes, said tubes containing a heavy gas and a light gas said furnace comprising:

A. at least three sections,

B. conveyer means for moving continuously and gradually tubes through said sections, C. means to maintain a suitable temperature and the passing through, mainly at atmospheric pressure, of suitable gases for the joining and sealing of tubes in the first section, the diffusion and exit of light gas through the tube walls in the second section, and the cooling in the third section, and wherein an inlet of the heavy gas into the furnace for the diffusion stage is placed in such a manner that, in the largest part of the diffusion section, the gas has a direction of motion opposite that of said conveyer means.

8. A furnace according to claim 7, wherein said conveyor means includes a belt.

9. A furnace according to claim 7, wherein said first and second sections have heating means associated therewith.

10. A furnace according to claim 7, wherein said furnace has inlet and outlet ports for the flow of gases therethrough.

* * * * *

UNITED STATES PATENT AND TRADEMARK OFFICE

CERTIFICATE OF CORRECTION

PATENT NO. : 4,383,723

DATED : May 17, 1983

INVENTOR(S) : Schleimann-Jensen

It is certified that error appears in the above-identified patent and that said Letters Patent are hereby corrected as shown below:

Drawing to indicate Sheet 1 of 1 (Figures 1, 2 and 3).
Delete Sheets 2 of 4, 3 of 4 and 4 of 4.

Signed and Sealed this

*Twenty-fifth* Day of *September 1984*

[SEAL]

*Attest:*

GERALD J. MOSSINGHOFF

*Attesting Officer*

*Commissioner of Patents and Trademarks*